US008714664B2

(12) United States Patent
Abreu

(10) Patent No.: US 8,714,664 B2
(45) Date of Patent: May 6, 2014

(54) ENVIRONMENTAL CONTAINMENT

(71) Applicant: Joseph Anthony Abreu, Long Beach, CA (US)

(72) Inventor: Joseph Anthony Abreu, Long Beach, CA (US)

( * ) Notice: Subject to any disclaimer, the term of this patent is extended or adjusted under 35 U.S.C. 154(b) by 0 days.

(21) Appl. No.: 13/837,248

(22) Filed: Mar. 15, 2013

(65) Prior Publication Data

US 2013/0198931 A1 Aug. 8, 2013

Related U.S. Application Data

(62) Division of application No. 13/470,033, filed on May 11, 2012.

(60) Provisional application No. 61/490,564, filed on May 26, 2011.

(51) Int. Cl.
*A61G 11/00* (2006.01)

(52) U.S. Cl.
USPC ..... 312/1; 312/245

(58) Field of Classification Search
USPC ..... 312/1, 3, 4, 5, 6, 245; 383/7, 10, 12, 13, 383/16
See application file for complete search history.

(56) References Cited

U.S. PATENT DOCUMENTS

| | | | | | |
|---|---|---|---|---|---|
| 4,604,111 | A * | 8/1986 | Natale | 95/284 |
| 4,753,367 | A * | 6/1988 | Miller et al. | 220/495.11 |
| 4,812,700 | A * | 3/1989 | Natale | 312/1 |
| 5,024,246 | A * | 6/1991 | Bain | 134/200 |
| 5,062,871 | A * | 11/1991 | Lemon, III | 55/385.2 |
| 5,520,449 | A * | 5/1996 | Klak | 312/1 |
| 5,884,989 | A * | 3/1999 | Truelove | 312/245 |
| 6,149,252 | A * | 11/2000 | Browning | 312/1 |
| 6,367,518 | B2 * | 4/2002 | Duncan | 141/97 |
| 6,793,617 | B2 * | 9/2004 | Ford et al. | 600/21 |
| 6,973,997 | B2 * | 12/2005 | Fara | 182/141 |
| 8,137,156 | B1 * | 3/2012 | Gasman | 451/28 |
| 2004/0027036 | A1 * | 2/2004 | Hall | 312/1 |
| 2008/0044114 | A1 * | 2/2008 | Hall et al. | 383/103 |
| 2012/0299452 | A1 * | 11/2012 | Abreu | 312/1 |
| 2012/0311932 | A1 * | 12/2012 | Cournoyer et al. | 49/13 |

* cited by examiner

*Primary Examiner* — Daniel Rohrhoff
(74) *Attorney, Agent, or Firm* — Clement Cheng

(57) ABSTRACT

An environmental containment system has a wall frame for mounting to a wall. The wall frame has a left section and a right section. The wall frame has a top section and a bottom section. The wall frame extends horizontally from a vertical plane and has a wall side opening and a working side opening. A suction opening is formed on the wall frame. A filter is mounted to a filter opening formed on the wall frame. A pair of mounting brackets are spaced apart horizontally at a set predetermined distance. The pair of mounting brackets includes a right mounting bracket and a left mounting bracket. The right mounting bracket has at least one right screw opening, and the left mounting bracket has at least one left screw opening. The pair of mounting brackets are mounted to an inside surface of the wall frame.

11 Claims, 13 Drawing Sheets

ENVIRONMENTAL CONTAINMENT

This application is a divisional of U.S. patent application Ser. No. 13/470,033 filed May 11, 2012, by same inventor Joseph Anthony Abreu, the disclosure of which is incorporated herein by reference. The parent application is a non-provisional claiming priority from provisional application 61/490,564 filed May 26, 2011, entitled Environmental Containment, by same inventor Joseph Anthony Abreu, the disclosure of which is incorporated herein by reference.

FIELD OF THE INVENTION

The present invention is in the field of environmental containment.

DISCUSSION OF RELATED ART

A variety of different environmental containment systems have been created for limiting the contamination of workers and the surrounding environment while dealing with the removal of hazardous materials. The most rudimentary environmental containment system has often been a bag with minimal entrance from the outside to prevent the escape of hazardous materials. Sometimes there are two holes for entrance of the hands to handle the materials inside the containment bag. Other environmental containment systems have been described in the art including United States patents.

For example, U.S. Pat. No. 4,626,291, issued on Dec. 2, 1986 to Natale, the disclosure of which is incorporated here by reference, is a portable containment device for treatment of hazardous materials, a containment bag system adopted for the purpose of removing asbestos insulation in an environmentally friendly manner. The containment bag with little access for outside particles to enter and with little leeway for containments from within to escape the bag, is a method for removing hazardous materials from limited areas. Natale further extends this idea to U.S. Pat. No. 4,812,700 on Mar. 14, 1989 to portable containment device specifically used for the treatment of hazardous materials such as the removal of asbestos insulation from pipes and valves that contain asbestos and possesses the potential of contaminating the active worker or the surrounding environment. This containment bag system requires a lay-flat tubing to be heated and sealed on the bottom edge and preferably heated and sealed along the two side edges as well.

In U.S. Pat. No. 4,817,644 issued to Holmes et al. on Apr. 4, 1989, the disclosure of which is incorporated herein by reference, a new and improved apparatus was introduced as an environmental containment system entitled apparatus and method for the safe and effective, large scale removal and disposal of hazardous materials from building components. This apparatus consists of non-rigid materials that are impervious to hazardous materials; and thus, allowing the user of the apparatus to effectively contain the hazardous materials within the elongate close-ended sheets.

In U.S. Pat. No. 5,520,449 issued on May 28, 1996, the disclosure of which is incorporated herein by reference, Klak features an asbestos glove bag. The glove bag includes two small holes for the hands to enter through the glove bag. It also comprises of a zip-loc closure within glove bag. The flap of the zip-loc closure is attached to the glove bag adjacent to an open top. This system requires a pressure sensitive adhesive strip. The removal of this strip will trigger the disposal of the hazardous materials it contains.

Other inventors have found that allowing for the portion of the waste-receiving containment bag to me sealed in addition to the containment bag itself being sealed is an additional safety measured. This is outlined in U.S. Pat. No. 4,883,329 issued to Flannery et al. on Nov. 28, 1989, the disclosure of which is incorporated herein by reference, to an environment containment system entitled asbestos containment bag with slide fastener closure. It consists of a gusset and slide fastener assembly inside the containment bag to allow for the adjustment of the waste-receiving portion of the containment bag. The bag can be sealed, unsealed, and resealed to accommodate for the quantity of hazardous materials.

Browning found in U.S. Pat. No. 6,149,252 issued on Nov. 21, 2000, the disclosure of which is incorporated herein by reference, that an environmental containment system is best structured as a glove box. A cylinder-shaped box is attached to the ceiling. There is a hole at the bottom of the cylinder-shaped box to allow for the user to reach into it to make cuts in the ceiling. The closed cylinder-shaped box then collects any dust, debris, and environmental contaminants from the cutting operation to allow for proper disposal.

SUMMARY OF THE INVENTION

An environmental containment system has a wall frame for mounting to a wall. The wall frame has a left section and a right section. The wall frame has a top section and a bottom section. The wall frame extends horizontally from a vertical plane and has a wall side opening and a working side opening. A suction opening is formed on the wall frame. A filter is mounted to a filter opening formed on the wall frame. A pair of mounting brackets are spaced apart horizontally at a set predetermined distance. The pair of mounting brackets includes a right mounting bracket and a left mounting bracket. The right mounting bracket has at least one right screw opening, and the left mounting bracket has at least one left screw opening. The pair of mounting brackets are mounted to an inside surface of the wall frame. An access door is mounted to the wall frame at a top opening. A hoop system is connected to the working side opening. A glove bag is configured to mount to the hoop system. The glove bag has a pair of gloves extending into the glove bag.

The access door opens inward and is spring-loaded. The hoop system is preferably rectangular. The vacuum is preferably mounted to the suction opening. The tool magnet is mounted to the inside surface of the wall frame. The second filter is mounted to a second filter opening formed on the wall frame. A third filter is mounted to a third filter opening formed on the wall frame. A fourth filter is mounted to a fourth filter opening formed on the wall frame. The hoop system is preferably rectangular, with the outside ring and the inside ring being rectangular.

The hoop system is formed of an outside ring and an inside ring. The inside ring has a ring groove for receiving a glove bag fold of the glove bag. The inside ring mates to the outside ring to retain the glove bag fold between the inside ring and the outside ring.

A glove bag comprises a bag portion and a glove portion. The bag portion has a pair of gloves extending into the bag portion, and the glove bag has an airtight connection to the glove portion at a thermal lamination. An opening on the bag portion can receive articles. A lower cavity is formed on the glove bag extending down to a floor to allow articles to rest on the floor. The lower cavity is formed below the glove portion. Article is preferably rest on an inside surface of the lower portion of the glove bag that retains articles such as asbestos and drywall.

Figure 1:
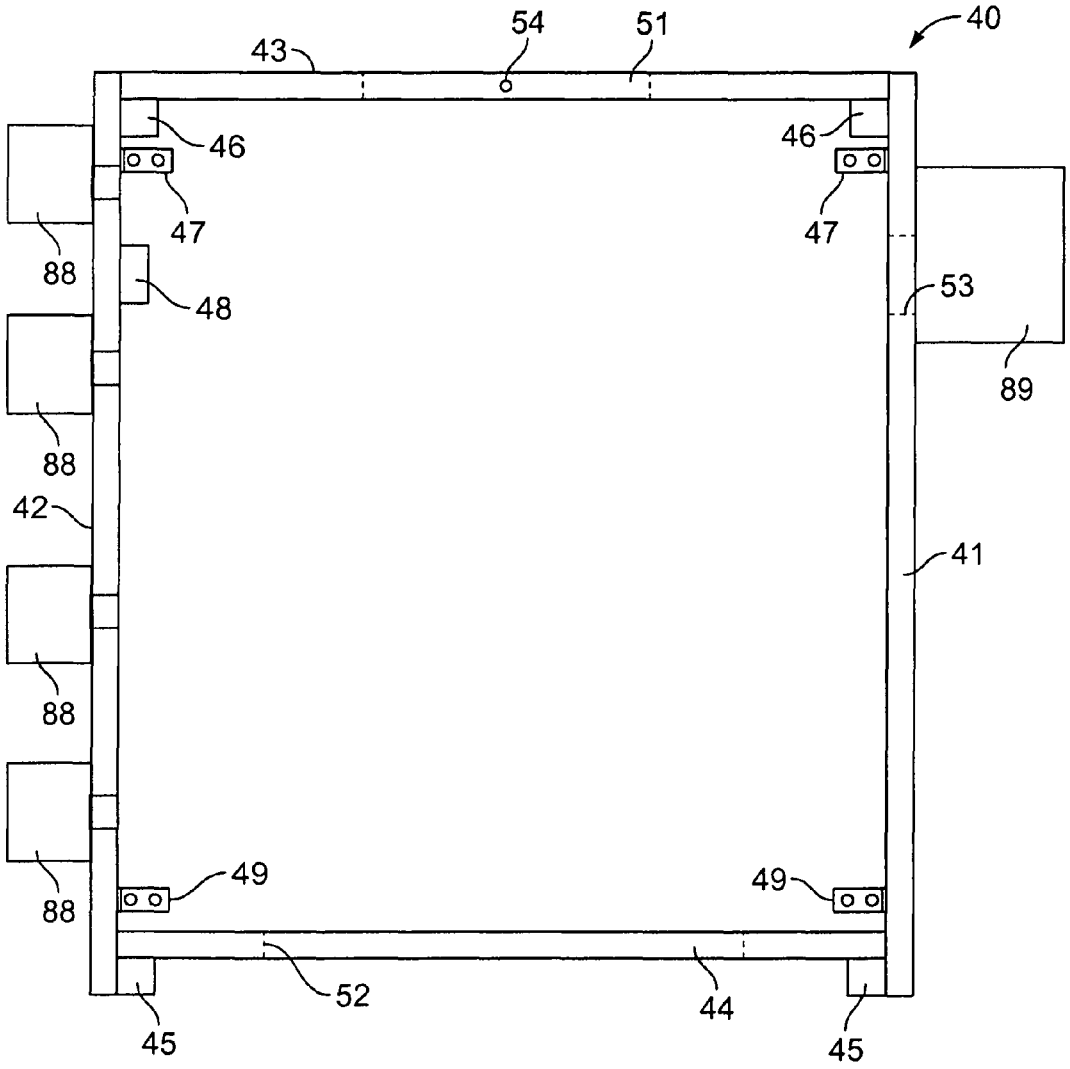
FIG. 1 is a front view of the wall frame seen from a direction facing the wall.

The following callout list of elements is a useful guide to reference the elements of the drawings.

20 Glove Assembly
21 Hand
22 Forearm
23 Elbow
24 Glove Fringe
25 Thermal Lamination
26 Glove Opening
27 Thumb
28 Forefinger
29 Middle Finger
30 Glove Bag
31 Glove Bag Fold Over
32 Glove Bag Bottom
33 Glove Bag First Seam
34 Glove Bag Second Seam
35 Glove Bag Opening
36 Glove Bag Fold
37 Outside Ring
38 Inside Ring
39 Ring Groove
40 Wall Frame
41 Right Section
42 Left Section
43 Top Section
44 Bottom Section
45 Bottom Corner Support
46 Top Corner Support
47 Top Mounting Brackets
48 Tool Magnet
49 Bottom Mounting Brackets
51 Top Opening
52 Bottom Opening
53 Suction Opening
54 Top Opening Hinge
60 Pocket Containment Method
61 First Step: Detect Access Area
62 Second Step: Find Studs-Measure And Mark
63 Third Step: Assemble Pc Wall Mount W/Tools In Place (Tape Outer Connection Points)
64 Fourth Step: Attach Wall Apparatus With All Four Screws Making Sure You Are Mounted To Bay Studs
65 Fifth Step: Tape All Areas With Industry Duct Tape Around Wall Mount And Walls
66 Sixth Step: Attach Recommended Hepa Vacuum With Retainer Ring
67 Seventh Step: Attach 6 Mil Bagging System
68 Eighth Step: Wet Area By Misting With Small Spray Bottle Of Recommended Wetting Agent
69 Ninth Step: Turn On Hepa Vacuum-Insert Hands Into Bagging System
70 Tenth Step: Cut Hole With Recommended Drywall Hand Saw
71 Eleventh Step: Remove Drywall And Place In Bag
72 Twelfth Step: Drop In Vacuum Attachment And Clean Bay Area Of All Debris And Dust
73 Thirteenth Step: Seal Top And Bottom Of Bay With Poly Strips And Industry Tape
74 Fourteenth Step: Mist Area (Make Sure Debris In Bag Is Adequately Wet) But Not Pooling At Bottom
75 Fifteenth Step: Wet Wipe Area and Tools-Remove Tools Except Screw Driver
76 Sixteenth Step: Wet Wipe Screw Driver And Re-Clean Area
77 Seventeenth Step: Temporarily Seal Bag With Industry Duct Tape
78 Eighteenth Step: Encapsulate With Approved Fiberlock Spray
79 Nineteenth Step: Let Dry 15 Minutes
80 Twentieth Step: Vacuum Out Air Inside Pc Bagging System, Twist Bag Minimum Of 5 Turns, Apply Industry Tape, And Detach Bagging System, Gooseneck Bag And Apply Tape Place In Second 6 Mil Clear Bag And Tape
81 Twenty-First Step: Fill Out Label (Homeowner, Date, Contents, Address Cad981400518 Epa Residential Not Commercial) And Attach To Bag
82 Twenty Second Step: Cut Or Remove Tape Around Wall Mount
83 Twenty Third Step: Remove And Disassemble Wall Mount
84 Twenty Fourth Step: Make Necessary Repair
85 Twenty Fifth Step: Cover Hole With Poly And Tape In Place
86 Twenty Sixth Step: Recommend To Have Materials Tested Before Further Removal Or Before Debris Discarded. Leave Waste On Site Until Testing Results Are Complete. Call Pc Hotline, 800 Provided By Plumber
88 Side Filter
89 Vacuum
90 Tape
91 Retainer Ring
92 Retainer Slot
93 Retainer Slot Opening
160 Pocket Containment Method
161 Step: Detect Access Area
162 Step: Find Studs-Measure And Mark Cut Area
163 Step: Before Beginning Isolate The Area With Critical Carriers (Poly Over Doors, Air Vents, Etc.)
164 Step: Assemble Wall Mount W/Tools In Place (Tape Outer Connection Points)
165 Step: Attach Wall Apparatus With All Four Screws Making Sure You Are Mounted To Bay Studs
166 Step: Tape All 4 Edges With Industry Duct Tape Around Wall Mount And Walls. Inside And Out
167 Step: Attach Recommended Hepa Vacuum Hose And Duct Tape Around Both Nozzles
168 Step: Wet Area By Misting With Small Spray Bottle Of Recommended Wetting Agent
169 Step: Attach 6 Mil Bagging System With Bag Attached

170 Step: Tape W/ Teal Duct Tape Inside Bottom Along Bagging System Edge And Wall Mount

171 Step: Turn On Hepa Vacuum—Adjust Flow With Dampener So Bag Doesn't Collapse Too Much

172 Step: All Work Performed Requires The Usage Of A Respirator Before Wall Removal

173 Step: Insert Hands Into Bagging System

174 Step: Cut Hole With Recommended Drywall Hand Saw

175 Step: Remove Drywall Exposing Pipe And Place In Bag.

176 Step: Drop In Vacuum Attachment And Clean Bay Area Of All Debris And Dust And Remove Bottom Strip Of Tape That Was Put On Bottom Of Bagging System. Clean Area.

177 Step: Mist Area (Make Sure Debris In Bag Is Adequately Wet) But Not Pooling At Bottom

178 Step: Wet Wipe Area and Tools and Remove Tools Except Screw Driver

179 Step: Remove Bottom Strip Of Tape That Was Put On Bottom Of Bagging System And Discard

180 Step: Vacuum Out Air Inside Bagging System, Twist Bag Minimum Of 5 Turns, Apply Industry Tape, And Wet Wipe Area

181 Step: Detach Inner Vacuum Hose And Tape Both Ends And Wet Wipe And Remove Hose

182 Step: Encapsulate With Approved Knock Down Spray Around All Drywall Edges And Inside Top And Bottom Of Bay. Use One Can To Ensure All Material Is Knocked Down.

183 Step: Detach Bagging System, Gooseneck Bag And Apply Tape, Place In Second 6 Mil Clear Bag And Tape Using Gooseneck Method.

184 Step: Detach Hose With Vacuum Still On And Dampener Wide Open, Hold Below Screws As You Unscrew Wall Unit To Capture Any Dust. When Removal Of Wall Mount Screws Is Complete And While Vacuum Is On, Tape End Of Hose With Duct Tape Then Turn Vacuum Off (Do Not Detach Hose Until Outside In Open Air (Wear Respirator)

185 Step: Cut Tape Around Wall Mount

186 Step: Remove Wall Mount

187 Step: Fill Out Label (Homeowner, Date, Contents, Address Cad981400518 Epa Residential Not Commercial) And Attach To Bag

188 Step: Let Dry 20 Minutes

189 Step: Make Necessary Repair To Plumbing

190 Step: Cover Hole With Poly And Tape In Place After Repair Is Made

191 Step: Remove Critical Barriers (Unless Mold Was Present)

192 Step: Recommend To Have Materials Tested Before Further Removal Or Before Debris Discarded. Leave Waste On Site Until Testing Results Are Complete. Call Hotline, 855-Labtogo For Waste Assistance

DETAILED DESCRIPTION OF THE PREFERRED EMBODIMENT

The present invention is an apparatus and method. The apparatus portion includes a wall frame 40 having the dimensions such as seen in FIG. 1. The wall frame is made of 4 sections, namely a top section 43, a bottom section 44, a left section 42 and a right section 41. As seen in the first figure, the top section has over a 16 inch distance length. The wall frame is placed over wall studs and mounting brackets 47 are provided with screw openings so that a user can drive a screw into the wall to attach the wall frame to the wall. On the left panel, or left section, the left panel includes a tool magnet 48 for holding tools such as a screwdriver or drywall knife. On the right panel, a hose opening allows connection to a hose. The bottom panel is shown with a HEPA filter.

An opening for the filter allows mounting of the filter in the opening. The top panel has a spring hinged flap access allow passage of tools downward to the tool magnet. The flap is sealed normally and is held closed by a spring and optionally a latch. The latch can be opened to allow passage of a tool to the wall frame. Four supports can provide additional structure for the wall frame. In an alternate embodiment, the elements can be placed in different orientations, such as if the filter were placed on the left side opposite the hose on the right side. In the primary embodiment, the air flow passes upward from the filter and flows out through the hose opening.

Figure 2:
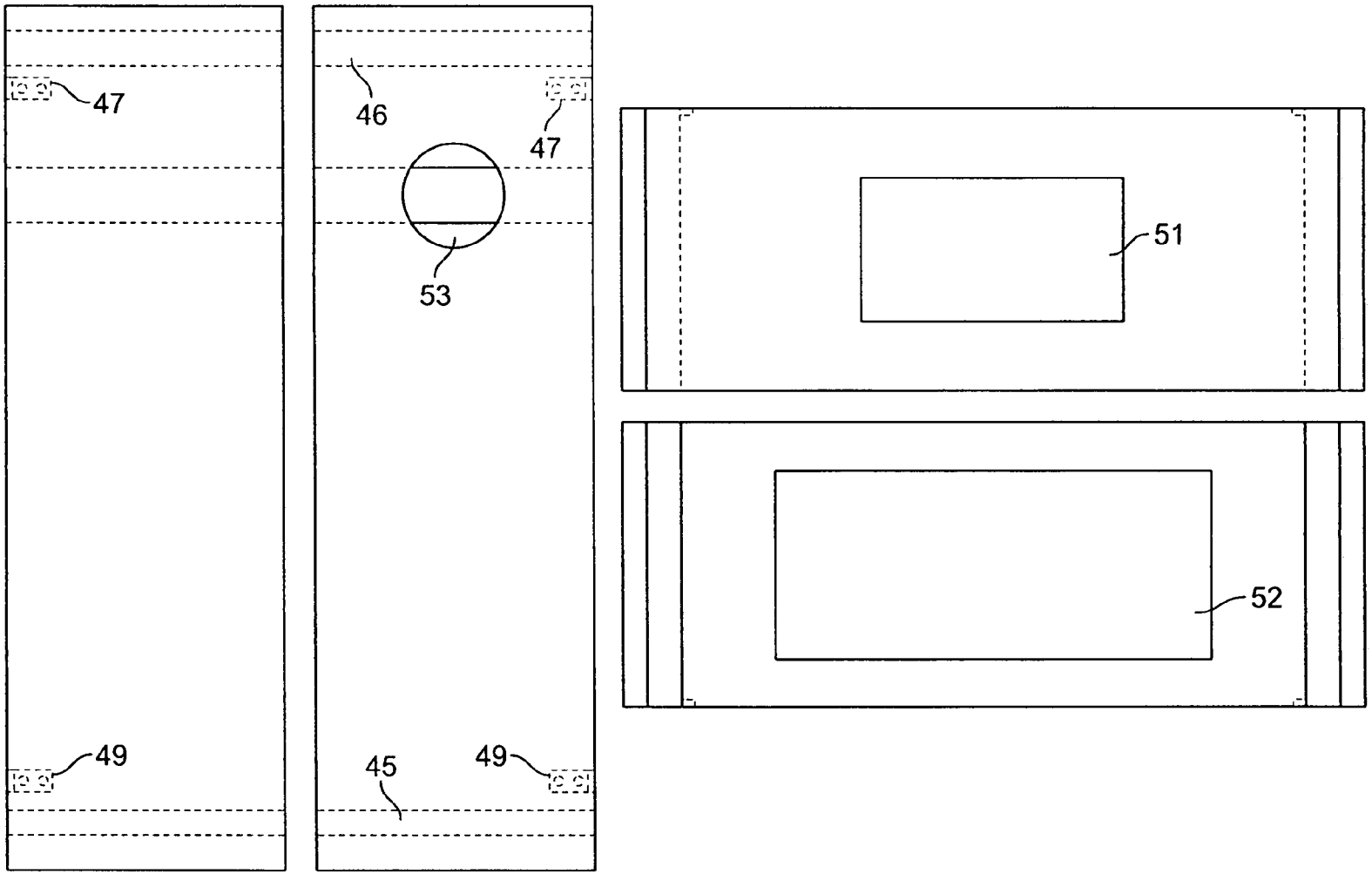
FIG. 2 is an exploded view showing the four panels of the frame including the left side, the right side, the top side and the bottom side.

In FIG. 2, the magnet is shown as a strip running the width of the left panel. Although the panels can be made of wood, they can also be formed as plastic members. The four supports can provide for interlocking plastic members. During transportation of the wall frame, the panel members are preferably carried in a bag stacked together. When assembled, the wall frame is preferably airtight.

Figure 3:
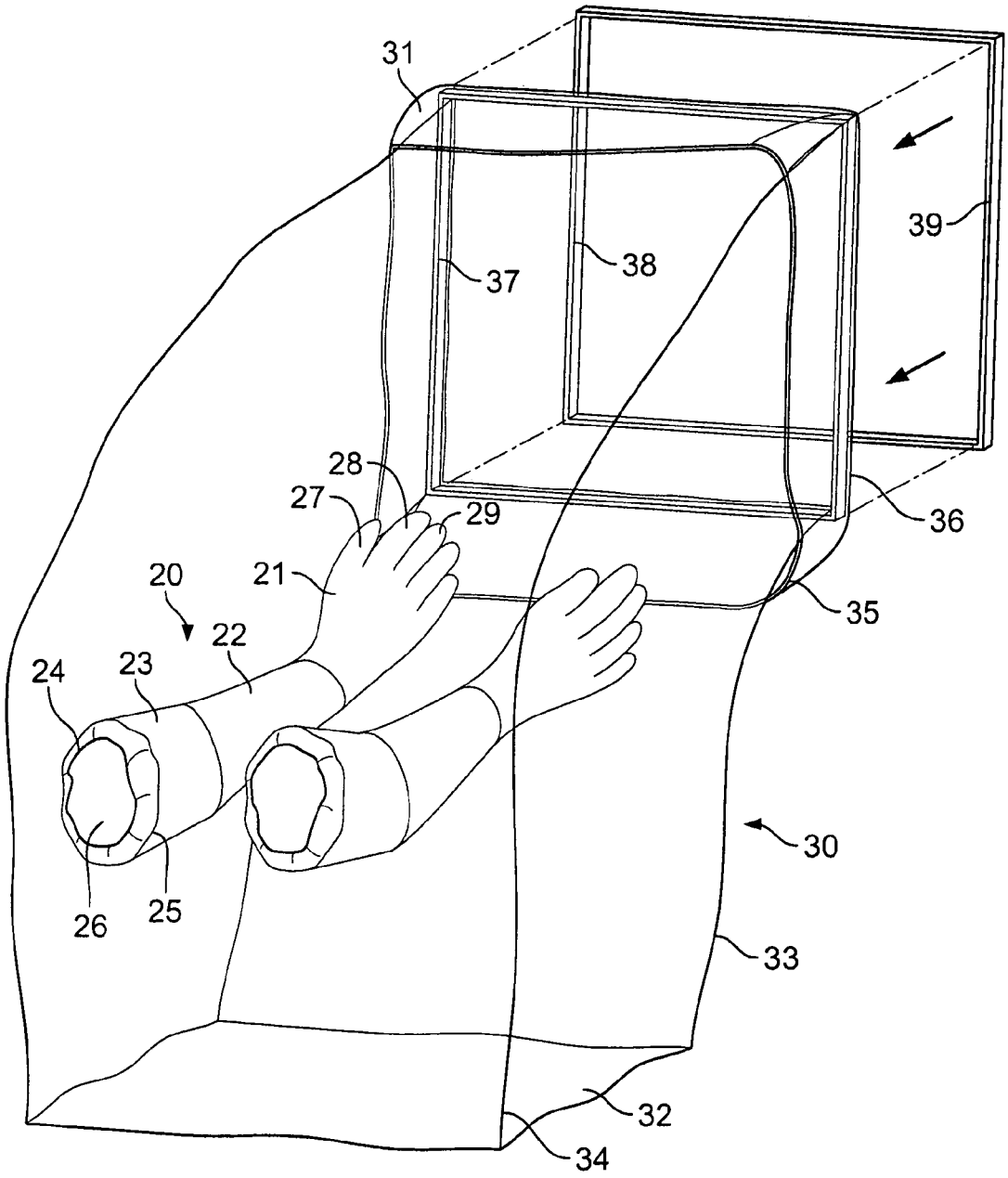
FIG. 3 is a diagram of the assembly of the glove bag to the inner ring and the outer ring.

A hoop system can be formed as a rectangular inner ring that fits with a rectangular outer ring. In FIG. 3, the inner ring and outer ring are shown as rectangular frames sandwiching and outer edge of a glove bag. The glove bag is preferably airtight against the inner ring and the outer ring. The pair of rings can be connected together by interference fit, magnetic, or by adhesive means. The inner ring and outer ring can be connected to the wall frame by interference fit, by magnetic means or by adhesive means.

Figure 4:
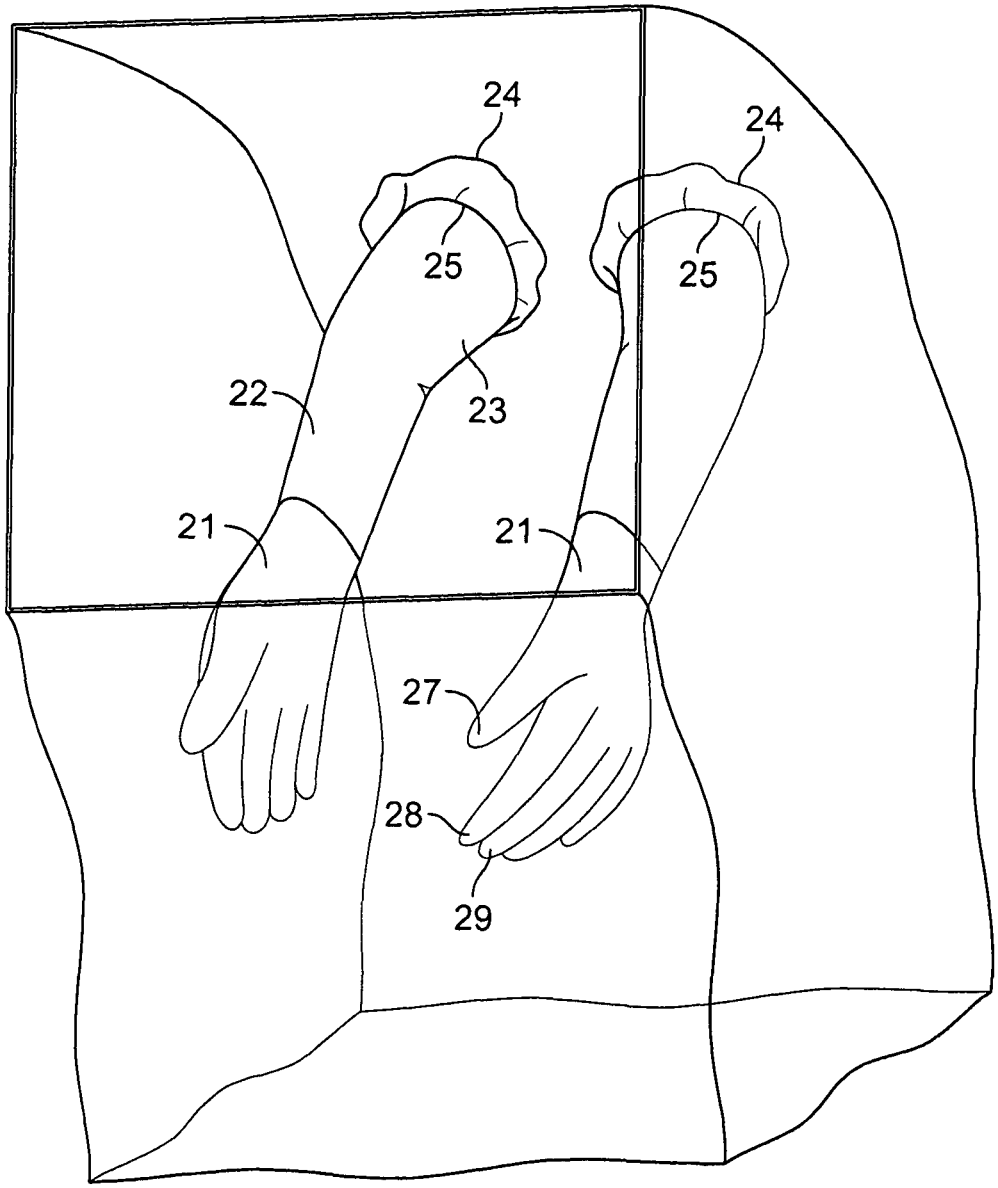
FIG. 4 is a diagram showing a rear view of a glove bag viewed from a direction facing away from the wall.
Figure 5:
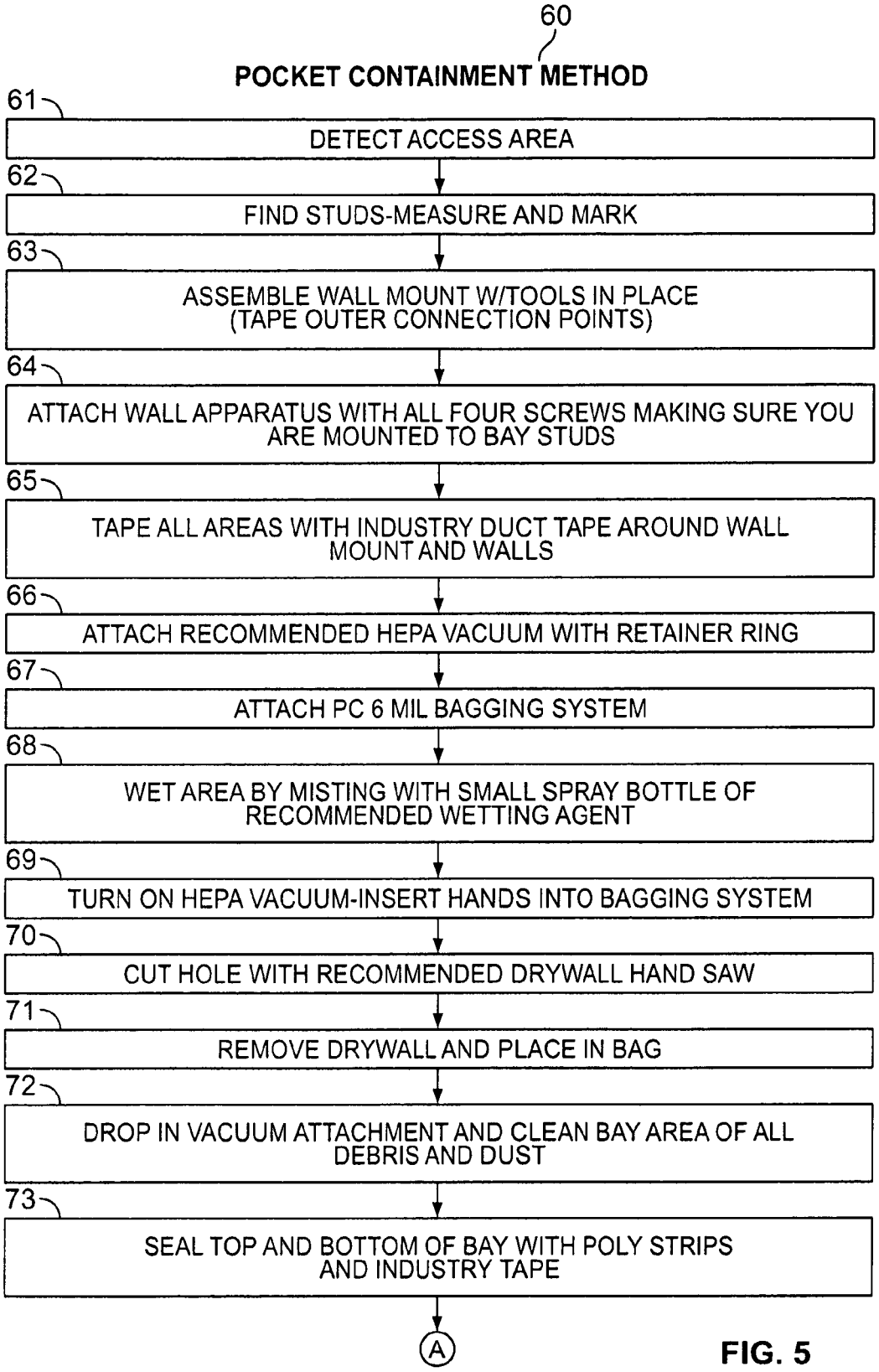
FIG. 5 is a diagram showing the steps for usage of a containment method abbreviated.
Figure 5:
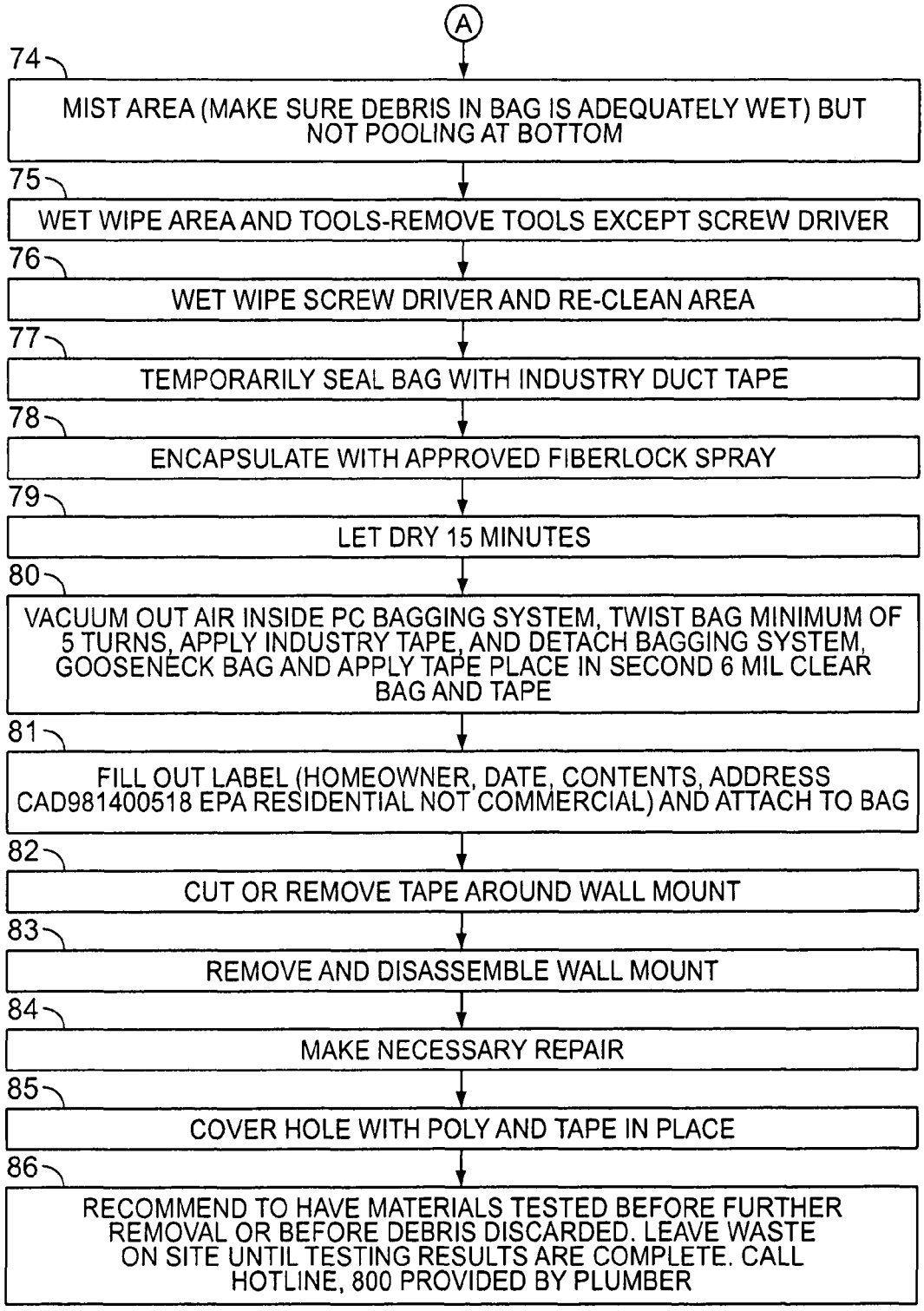
Figure 6:
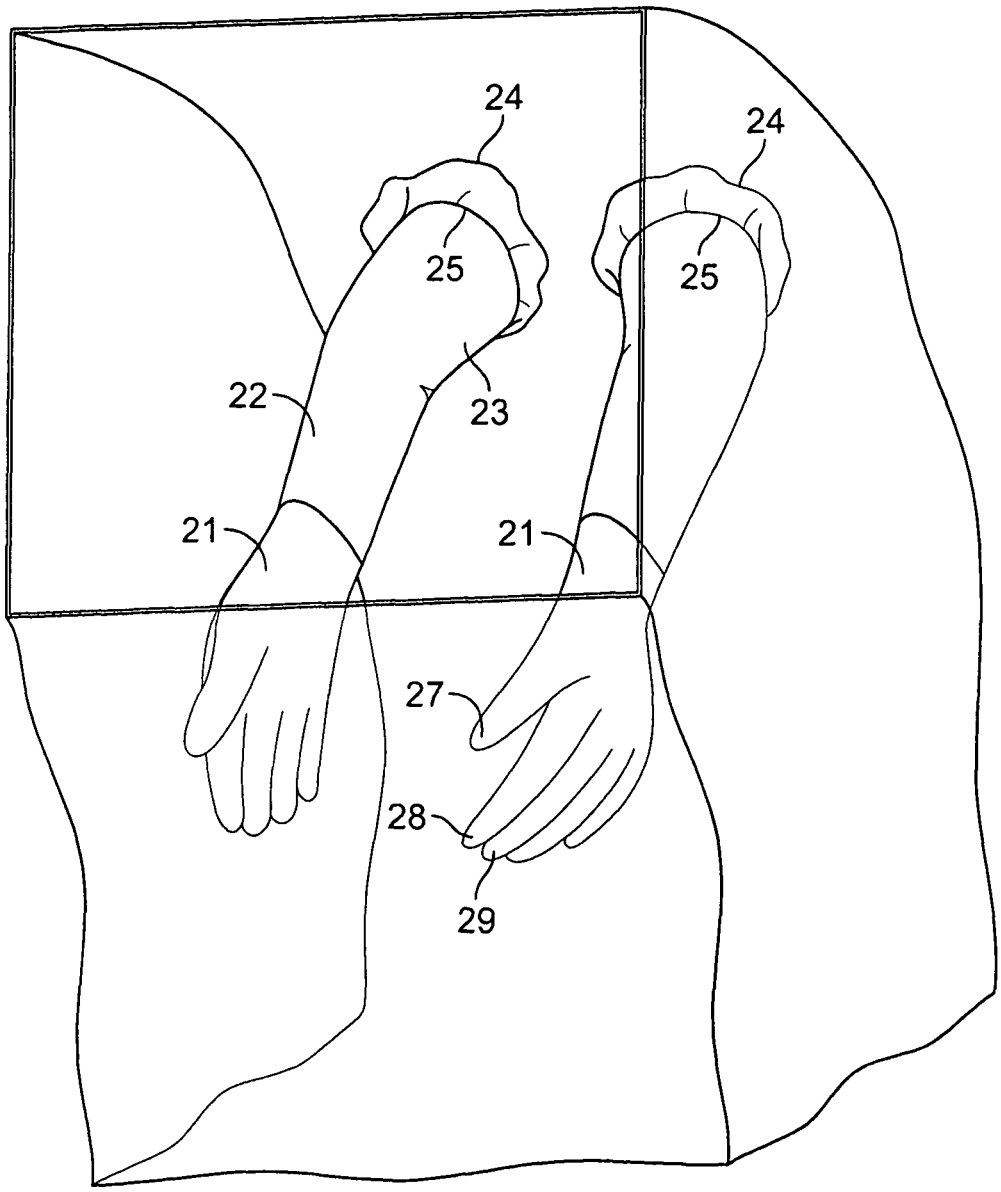
FIG. 6 is a diagram of a glove bag that is drawn in an expanded position for sake of clarity. during actual usage, the glove bag may be partially collapsed and contain asbestos and drywall.

The wall frame may have a slot formed in the top member in the side members to provide an insertion from the top of the pair of rings including the inner ring and outer ring. The wall frame and the pair of rings is preferably square shaped to allow sideways or upside down mounting. The bag shown in FIG. 4 provides a glove bag having a pair of gloves attached to a bag and then having a lower area to carry debris.

The wall frame 40 generally has a right section 41 and a left section 42. The right section 41 or left section 42 preferably has a suction opening 53 disposed in it. The right section or left section preferably has a tool magnet 48 mounted to it as well. The left or right section, also called the side sections are supported by the tape as well as the top mounting brackets 47 and the bottom mounting brackets 49. The side sections when formed as planks are preferably connected to the top section 43 with top corner supports 46. The side sections when formed as planks are also preferably connected to the bottom section 44 by bottom corner supports 45. The bottom corner supports 45 can be formed as wooden elongated members. Alternatively, the top mounting brackets 47 can be secured to the top section and the bottom mounting brackets 49 can be secured to the bottom section.

The top section 43 preferably has a top opening 51 with a top opening hinge 54 that opens inward and is spring-loaded so that it closes the top opening flap with an air tight seal. The top section can also have a top opening flap that opens outward, but this is not preferred. The bottom section can have a bottom opening 52. The bottom opening 52 includes a filter for filtering air so that air is moving upward.

Figure 7:
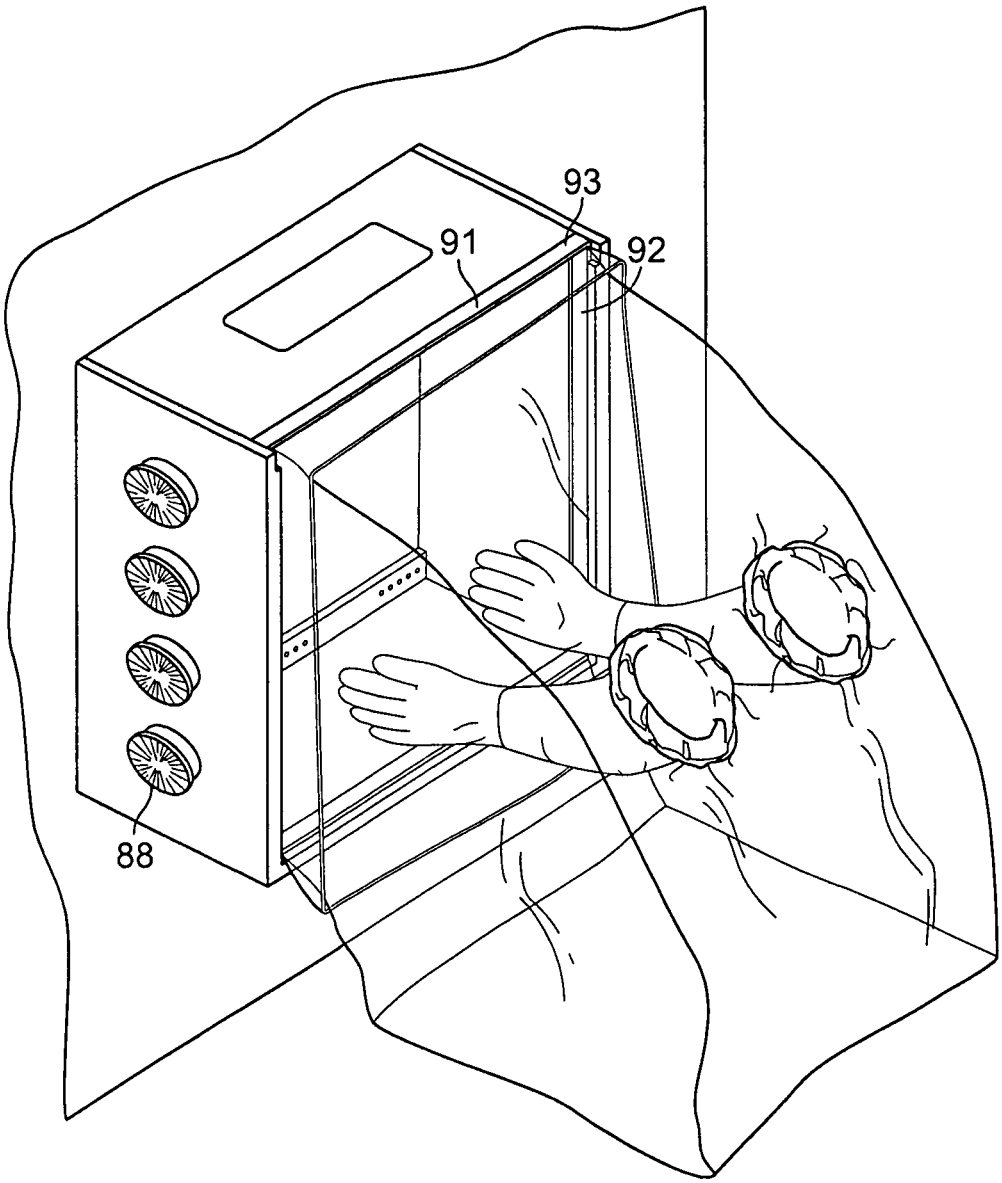
FIG. 7 is a diagram of a glove bag attached to the wall frame.
Figure 8:
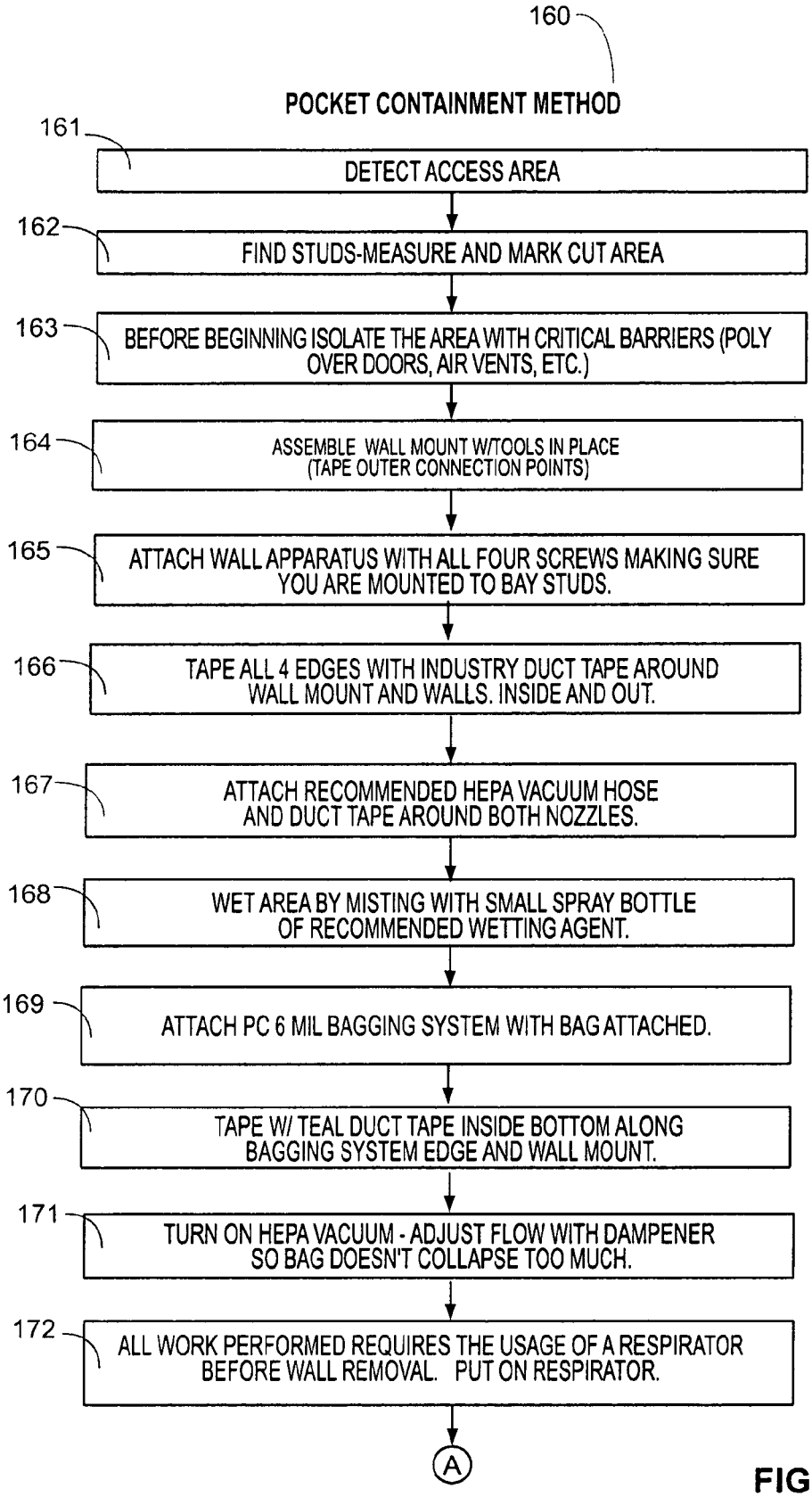
FIG. 8 is a diagram showing the steps of the containment method.
Figure 8:
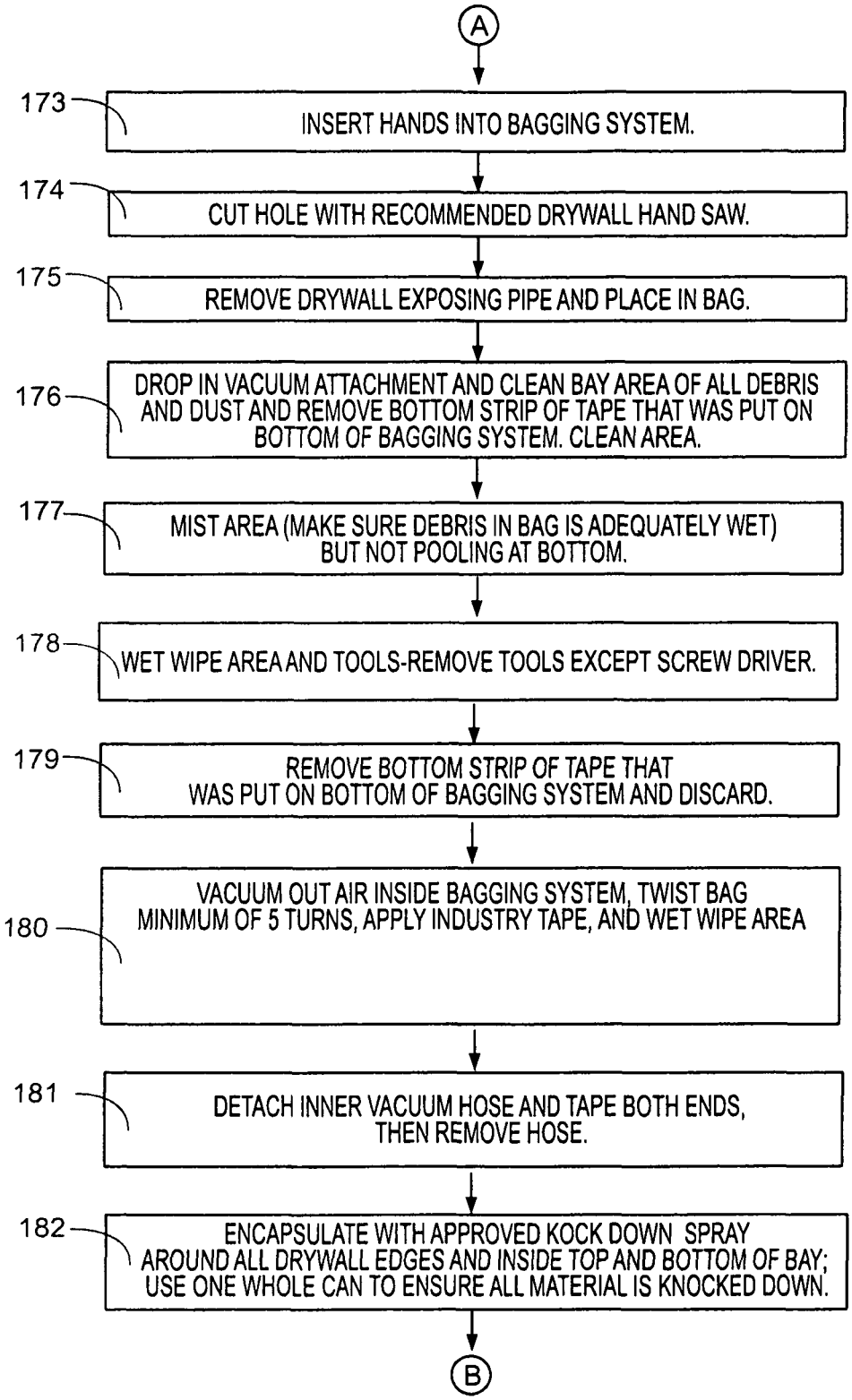
Figure 8:
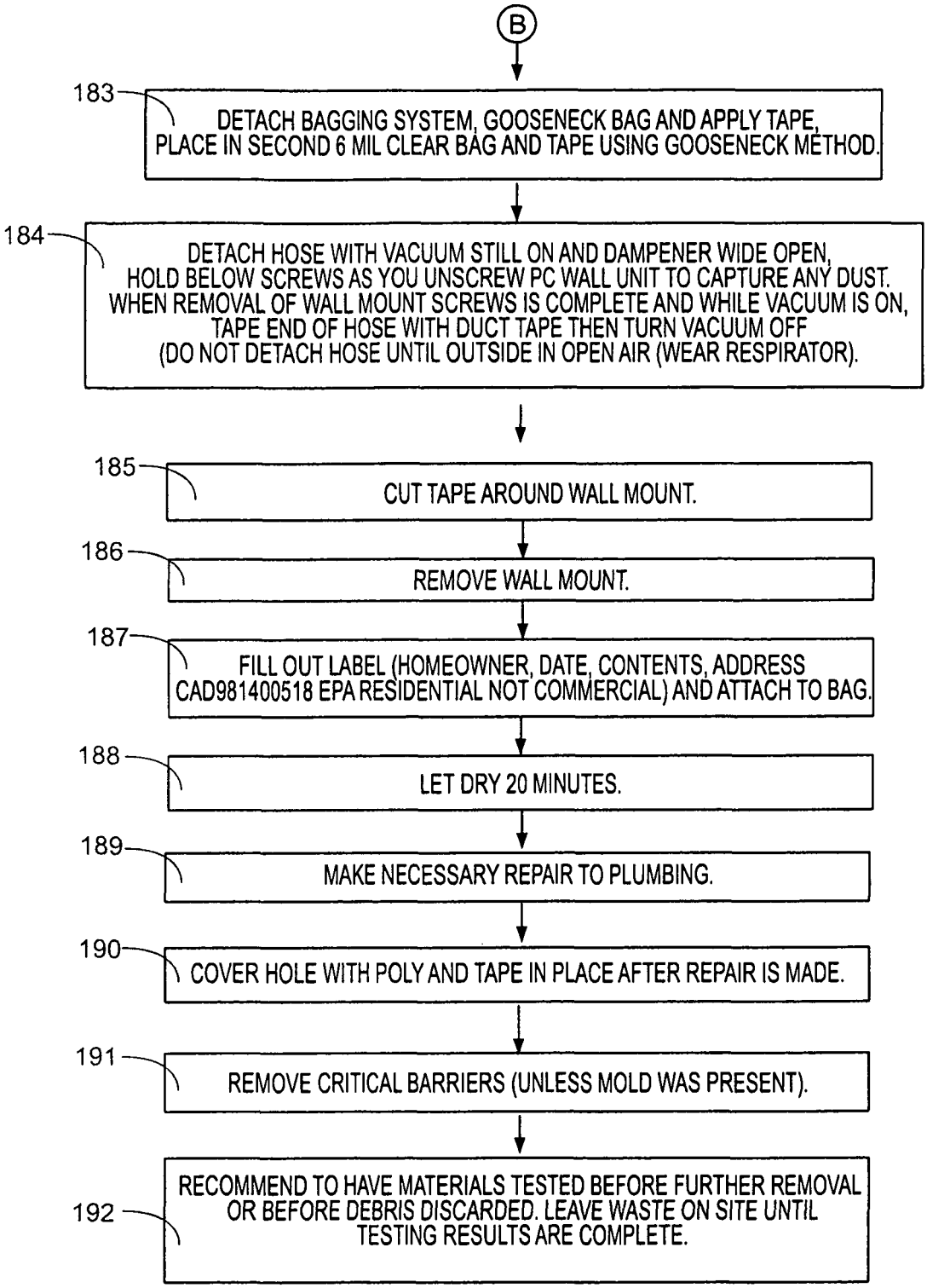
Figure 9:
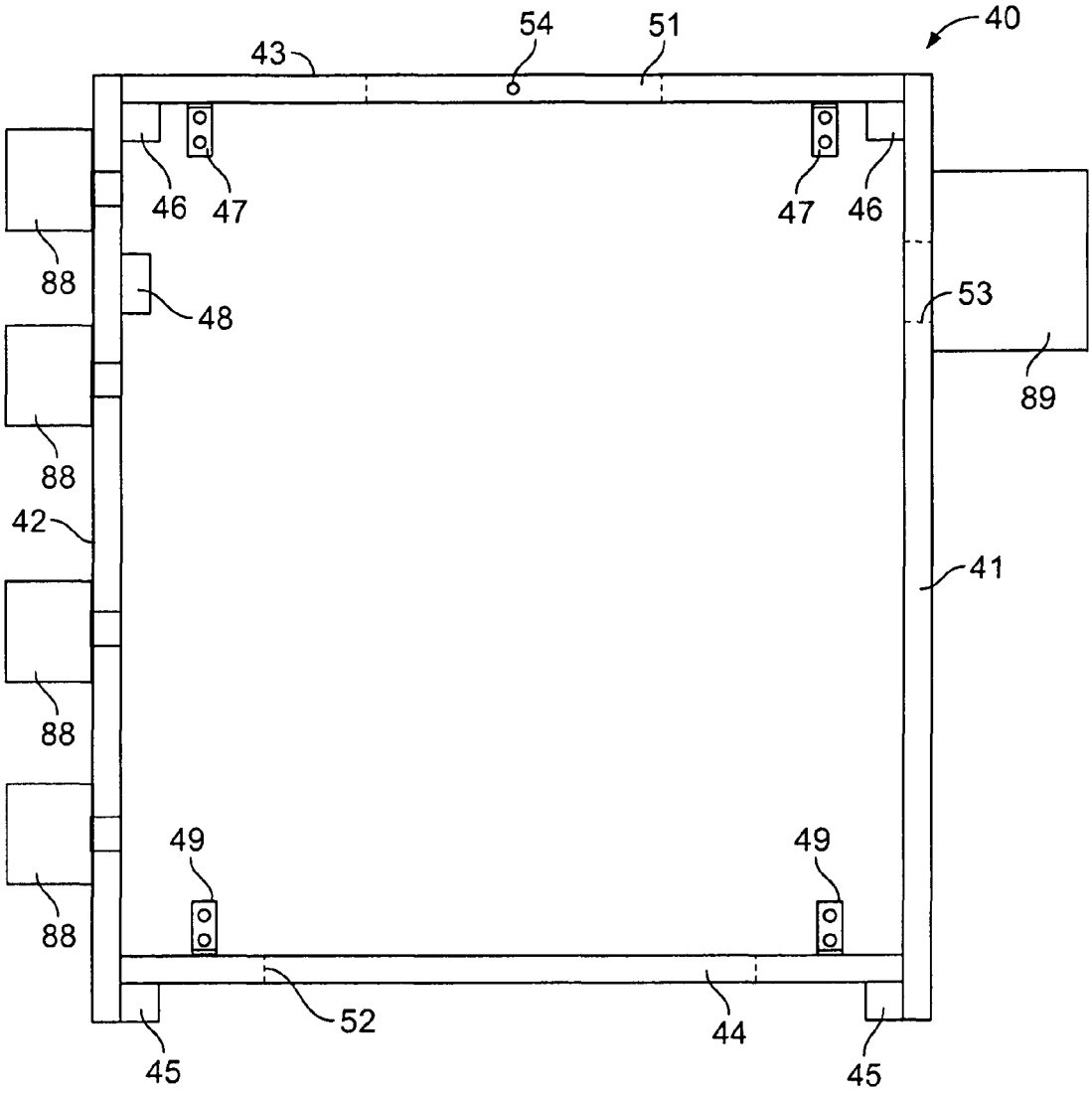
FIG. 9 is a diagram of the assembly of the wall frame with mounting brackets connected to the top and bottom sections of the wall frame.
Figure 10:
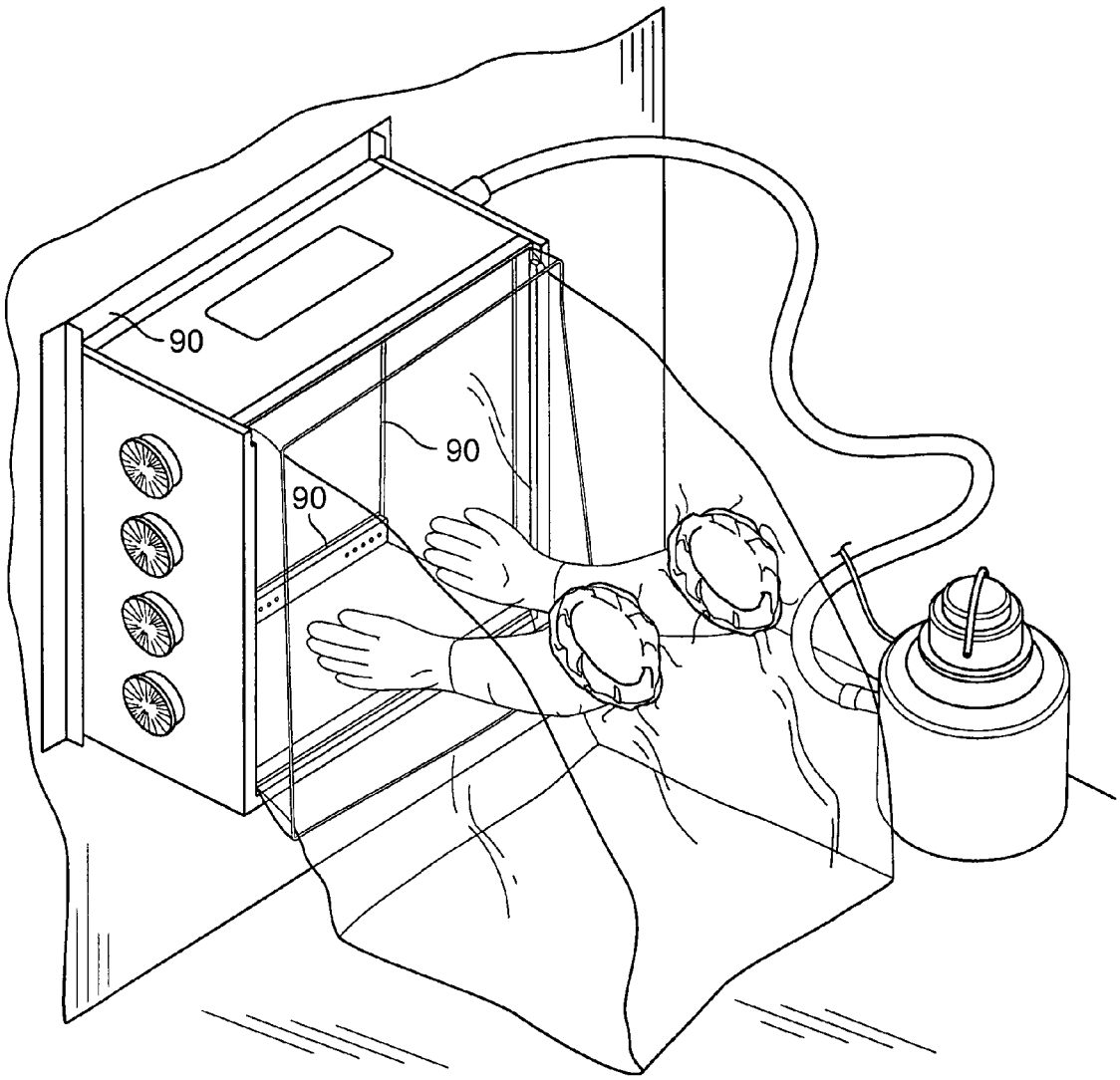
FIG. 10 is an environmental view of the present invention showing the unit mounted to a wall with an external vacuum and vacuum hose connected.

In an improved version of the present invention, the filter assembly is a side filter 88 mounted on a left or right side of the wall frame 40. As seen in FIG. 7, four small circular filters can be used. Additionally, in vacuum 89 such as an integrated vacuum can be mounted to the side of the wall frame 40, opposite the side filters 88. In the improved version of the present invention, the airflow flows from the side filters side of the apparatus to the vacuum site of the apparatus. The vacuum may have a variable control on it. The suction opening 53 optionally includes an air filter for filtering air leaving the unit. It is preferred that the side filters 80 are mounted on a side filter openings disposed in a side of the wall frame 40. With an integrated vacuum, the housing of the vacuum can be mounted directly to the wall frame 40, or can be connected to the suction opening 53 by a hose. It is preferred that the tape 90 is color contrasting to the side of the wall frame 40.

The glove assembly 20 has a hand 21. The hand portion of the glove assembly includes at least a thumb 27, a forefinger 28 and a middle finger 29. The hand 21 is preferably heat laminated to the forearm 22. The forearm and hand can be made of a rubber or plastic. It is preferred that the forearm and hand are made of a rubbery plastic material commonly used for gloves. The forearm may optionally extend to an elbow section 23 that is heat laminated to the forearm. The glove assembly 20 is laminated to the glove bag at a thermal lamination 25. The glove fringe 24 extends from the thermal lamination 25 and may have an edge forming a glove opening 26. Optionally, the glove fringe 24 has elastic for changing in size.

The glove assembly 20 is airtight when connected at the thermal lamination 25 to the glove bag 30. A pair of gloves allows a user to use both hands.

The glove bag 30 has a glove bag bottom 32 that may have a fold at the bottom. Preferably, a seam does not run across the bottom. The glove bag is connected to the outside ring 37 and the inside ring 38 by being sandwiched at a glove bag fold 36. The glove bag fold 36 is pushed into the ring groove 39 that is disposed on either the outside ring 37 or on the inside ring 38. The outside ring and the inside ring can be made to snap together or come together by magnetic attachment. The outside ring and the inside ring form a retainer ring. The retainer ring 91 fits inside a retainer ring slot 92 formed on the left and right sections of the wall frame 40. The retainer ring slot 92 begins at a retainer slot opening 93 formed on the top section of the wall frame 40.

A portion of the glove bag 30 is folded over to form a glove bag fold over 31. The edge of the glove bag fold over is the glove bag opening 35. The glove bag first seam 33 and the glove bag second seam 34 can be formed at corners of the glove bag, or on a left and right side of the glove bag. A glove bag bottom 32 can be made flat.

The first embodiment of the pocket containment method 60 is a simplified version and may have a number of different steps in addition to the ones listed. The first step 61 is to detect the access area. The second step 62 is to find studs and then measure and mark them. The third step 63 is to assemble a wall mount with tools in place and also taped the outer connection points. The fourth step 64 is to attach a wall apparatus with four screws and making sure they are mounted to bay studs. A fifth step 65 is to tape all areas with industry duct tape around the wall mount and walls. A sixth step 66 is to attach a HEPA vacuum with retainer ring to the suction opening 53. A retainer ring clips to the outside of the suction opening 53.

The seventh step 67 is to attach a 6 mil bagging system such as glove bag 30. The eighth step 68 is too wet in the area by missing with a small spray bottle having a wetting agent. The ninth step 69 is to turn on the Hepa Vacuum and then insert hands into the bagging system. The $10^{th}$ step is to cut a hole with the recommended drywall hand saw. The $11^{th}$ step 71 is to remove the drywall and place it in the glove bag 30. The drywall will generally rest of the floor toward the bottom of the glove bag 30. The $12^{th}$ step 72 is to drop in the vacuum attachment and clean the bay area of all debris and dust. The $13^{th}$ step 73 is to seal the top and bottom of the bay with poly strips and industry tape. The $14^{th}$ step 74 is to mist the area making sure that debris and the bag is adequately wet but not pooling at the bottom. The $15^{th}$ step 75 is to wipe the area and tools and to remove all of the tools except for the screwdriver. The $16^{th}$ step 76 is to wet wipe the screwdriver and to reclean the area.

The $17^{th}$ step 77 is to temporarily seal the bag with industry duct tape. The $18^{th}$ step 78 is to encapsulate the cut area with a lock down encapsulate spray. The $19^{th}$ step 79 is to let the area dry for 15 minutes. The $20^{th}$ step 80 is to vacuum out air inside the glove bag, then twist the bag and minimum of five turns and applied industry tape to close the bag. The bagging system is then detached and the bag is goose necked which means to be folded over again. The bag is twisted a minimum of five turns during closing. It is preferred to apply tape and the place the glove bag 30 into another 6 Mil clear bag which is then also taped in the same manner. The $21^{st}$ step 81 is to fill out a label and attach the label to the bag. The label should have the details of: Homeowner, Date, Contents, Address and a notation of Cad981400518 Epa Residential Not Commercial. The $22^{nd}$ step 82 is to cut or remove tape around the wall mount. The $23^{rd}$ step 83 is to remove and disassemble the wall mount. The $24^{th}$ step 84 is to make any necessary repairs. The $25^{th}$ step is to cover the hole was a poly sheet of plastic and tape in place. The $26^{th}$ step is to have materials tested before for the removal or debris is discarded and to leave always on-site until testing results are completed. A card such as a hotline number can be provided by a plumber.

A second embodiment of the pocket containment method 160 is the best mode of the present invention. The pocket containment method 160 has a number of steps, and may have other steps not included in the listed steps. The first step 161 is to detect the access area. The second step 162 is find the wall studs and measure and mark for cutting the area. The third step 163 is to isolate the area with critical carriers such as poly plastic sheet over doors and air vents and other air openings. The fourth step 164 is to assemble the wall mount with tools in place and to tape the outer connection points. The fifth step 165 is to attach the wall apparatus with all four screws making sure that they are mounted to the bay studs. The sixth step 166 is to tape all four edges with industry duct tape all around the wall mount and walls inside and out. The seventh step 167 is to attach the recommended HEPA vacuum hose and duct tape around both nozzles. The eighth step 168 is to wet the area by missing it with a small spray bottle of a wetting agent such as alcohol or water. The ninth step 169 is to attach a 6 mil bagging system with a glove bag attached between the outside mounting ring and the inside mounting ring. The $10^{th}$ step 170 is to tape with teal colored duct tape inside, along the bottom and all along the bagging system edge and wall mount.

The $11^{th}$ step 171 is to turn on the HEPA vacuum and adjusts the flow with a dampener so that the bag doesn't collapse too much. The $12^{th}$ step 172 is to use a respirator before opening the wall. The $13^{th}$ step 173 is to insert hands into the bagging system. The $14^{th}$ step 174 is to cut a hole with a drywall hand saw. The $15^{th}$ step is to remove the drywall and place it in a bag. The $16^{th}$ step 176 is to drop in the vacuum attachment and clean the bay of all debris and dust and remove the bottom strip of tape that was put on the bottom of the bagging system. The bay area is cleaned. The 17th step 177 is to mist the area making sure that the debris of the bag is adequately wet but not pooling at the bottom hollow of the bag. The 18th step 178 is to wet wipe around the area and tools and remove the tools except for the screwdriver.

The 19th step 179 is to remove the bottom strip of tape that was put on bottom of bagging system and discard. The 20th step 180 is to vacuum out air inside the bagging system, then twist the bag a minimum of five turns and apply industrial tape. After that, wet wipe the inside area of the bay.

The 21st step 181 is to detach the inner vacuum hose and tape both ends and then what wipe and remove the vacuum hose. The 22nd step 182 is to encapsulate the area all around the drywall edges and inside the top and bottom of the bay with fiber knock down spray so that fibers do not become airborne. It is suggested to use one can to ensure all material is knocked down.

The 23rd step 183 is to detach the bagging system which includes the glove bag. The glove bag is then goose necked in the taped again and then placed in a second 6 mil clear bag which is in turn taped using the same gooseneck method. The 24th step 184 is to detach and the hose with the vacuum still on and dampener wide-open. The vacuum is held on or beneath the screws, to capture dust as the user unscrews the screws on the wall unit. When the remove all the wall mount screws is complete, and while the vacuum is on, the user tapes the end of the hose with the duct tape and then turns the vacuum off. The user does not detach the hose until outside in open air and wearing a respirator. Also, the hose can remain taped. The 25th step 185 is to cut the tape around the wall mount. The $26^{th}$ step 186 is to remove the wall mount from the wall. The 27th step 187 is to fill out a label and attach it to the bag. The label may include information such as: Homeowner, Date, Contents, Address, the notation Cad981400518 Epa Residential Not Commercial. The 28th step 188 is to let the area dry for 20 minutes. The 29th step 189 is to make necessary repairs to plumbing. The 30th step 190 is to cover the hole with poly sheet of plastic and tape in place after a repair is made.

The 31st step 191 is to remove the critical barriers, unless mold is present, in which case the barriers should remain. The $32^{nd}$ step 192 is to have materials tested before the debris is discarded. It is preferred to leave the waste on site until testing results are complete. A hotline number can be provided to the user and imprinted on the label or tag such as, 855-LAB-TOGO for waste assistance.

The invention claimed is:

1. A glove bag including an environmental containment system that includes a wall frame for mounting to a wall that is vertically oriented, wherein the wall frame extends horizontally from a vertical plane and has a wall side opening and a working side opening; a suction opening formed on the wall frame; a filter mounted to a filter opening formed on the wall frame; a pair of mounting brackets spaced apart horizontally at a set predetermined distance, wherein the pair of mounting brackets includes a right mounting bracket and a left mounting bracket, wherein the right mounting bracket has at least one right screw opening, and wherein the left mounting bracket has at least one left screw opening, wherein the pair of mounting brackets are mounted to an inside surface of the wall frame; an access door mounted to the wall frame at a top opening; and a hoop system connecting to the working side opening; wherein the glove bag has:

a. a bag portion;

b. a glove portion, wherein the bag portion has a pair of gloves extending into the bag portion, wherein the glove bag has an airtight connection to the glove portion at a thermal lamination;

c. an opening on the bag portion to receive articles; and d. a lower cavity formed on the glove bag extending down to a floor to allow articles to rest on the floor, wherein the lower cavity is formed below the glove portion.

2. The glove bag of claim 1, wherein the access door opens inward and is spring-loaded.

3. The glove bag of claim 2, wherein the hoop system is rectangular.

4. The glove bag of claim 2, further comprising a vacuum mounted to the suction opening.

5. The glove bag of claim 1, wherein the hoop system is rectangular, wherein the outside ring and the inside ring are rectangular.

6. The glove bag of claim 1, wherein the hoop system is formed of an outside ring and an inside ring, wherein the inside ring has a ring groove for receiving a glove bag fold of the glove bag, wherein the inside ring mates to the outside ring to retain the glove bag fold between the inside ring and the outside ring.

7. The glove bag of claim 6, wherein the hoop system is rectangular.

8. The glove bag of claim 6, further comprising a vacuum mounted to the suction opening.

9. The glove bag of claim 6, further comprising a tool magnet mounted to the inside surface of the wall frame.

10. The glove bag of claim 6, further comprising a second filter mounted to a second filter opening formed on the wall frame.

11. The glove bag of claim 6, wherein the hoop system is rectangular, wherein the outside ring and the inside ring are rectangular.

* * * * *